US005943753A

United States Patent [19]

Buchsbaum et al.

[11] Patent Number: 5,943,753

[45] Date of Patent: Aug. 31, 1999

[54] PLANT FOR PRODUCING A HOT-ROLLED PRODUCT

[75] Inventors: Bernhard Buchsbaum, St. Georgen/G.; Karl Christian Gruber, Pucking, both of Austria

[73] Assignee: Voest-Alpine Industrienanlagenbau GmbH, Linz, Austria

[21] Appl. No.: 09/168,078

[22] Filed: Oct. 8, 1998

[30] Foreign Application Priority Data

Oct. 10, 1997 [AT] Austria ..... 1720/97

[51] Int. Cl.[6] ..... B23P 17/00; B21B 1/46

[52] U.S. Cl. ..... 29/33 C; 164/441

[58] Field of Search ..... 29/33 C, 527.7; 164/70, 418, 442, 484, 420; 72/228

[56] References Cited

U.S. PATENT DOCUMENTS

| | | | |
|---|---|---|---|
| 3,648,359 | 3/1972 | Dennis | 164/420 X |
| 5,305,515 | 4/1994 | Pastert et al. | 29/33 C X |
| 5,467,518 | 11/1995 | Mertens | 29/527.7 |
| 5,601,137 | 2/1997 | Abe et al. | 164/418 |

FOREIGN PATENT DOCUMENTS

| | | | |
|---|---|---|---|
| 0492226 B1 | 7/1992 | European Pat. Off. . | |
| 0593002 B1 | 4/1994 | European Pat. Off. . | |
| 3901582 A1 | 8/1990 | Germany . | |
| 1066680 | 1/1984 | U.S.S.R. | 72/228 |

*Primary Examiner*—William Briggs

[57] ABSTRACT

There is disclosed a plant for producing a hot-rolled product from a cast strand comprising two or several continuous casters and a rolling mill associated therewith and respective guide sections for transporting a strand piece separated from the cast strand. A pivotable or laterally displaceable guide section is each provided in at least one line of the rolling mill and in a line not registering with the former, of the continuous caster. The guide sections are capable of being aligned in a mutually registering position. In order to reach a high plant availability, at least one pivotable and/or laterally displaceable guide section is provided with two or several guide parts each serving to receive strand pieces and capable of being alternately aligned to register with the line of the rolling mill. In one position of this guide section, a pivotable and/or laterally displaceable guide section of an adjacently arranged line of a continuous caster is alignable to register with one of the guide parts of the guide section including two or several guide parts and, in this position, a second guide part of this guide section is aligned to register with the line of the rolling mill.

8 Claims, 4 Drawing Sheets

PLANT FOR PRODUCING A HOT-ROLLED PRODUCT

BACKGROUND OF THE INVENTION

1. Field of the Invention

The invention relates to a plant for producing a hot-rolled product from a cast strand, comprising two or several continuous casters and a rolling mill associated therewith and respective guide sections for transporting a strand piece separated from the cast strand, wherein a pivotable or laterally displaceable guide section is each provided in at least one line of the rolling mill and in a line of a continuous caster not registering with the former, which are capable of being aligned in a mutually registering position.

2. Prior Art

An arrangement of this kind is known from EP-B 0 492 226 and EP-B 0 593 002.

According to EP-B 0 492 226, the diversion of a strand piece from the line of one of the continuous casters into the line of the rolling mill is effected by means of two guide sections designed as swing furnaces, wherein one swing furnace is arranged in the line of the continuous caster and the second swing furnace is arranged in the line of the rolling mill and both of the swing furnaces in one pivoted position each are capable of being aligned so as to register with the line in which they are arranged and in a second pivoted position each are capable of being placed in a straight line connection with the free ends of the two swing furnaces joining each other.

It is thereby possible, after having introduced a strand piece into the swing furnace arranged in the line of the continuous caster, to pass over into the swing furnace provided in the line of the rolling mill by pivoting the swing furnaces into the connected position and to subsequently feed the thus diverted strand piece to the rolling mill by pivoting back the second swing furnace into the line of the rolling mill.

A very similar method and arrangement are known from EP-B 0 593 002, wherein also there two pivotable or laterally movable furnaces are provided, which serve to divert a strand part from a line of a continuous caster into the line of the rolling mill. Also there, the two movable furnaces join each other in an aligned manner, yet the conveying direction of the strand part is reversed two times, i.e., the strand piece when being conveyed from one line to the other moves in the opposite direction to the conveying direction of the continuous caster and the rolling mill.

Those known plants involve the drawback of the imperative timed coupling of the two pivotable or movable furnaces, since they must be aligned to mutually register in order to divert a strand piece. Hence results the timed coupling of the lines of the continuous casters with the line of the rolling mill. During diversion it is, in fact, not feasible to continue to operate the line from which, or into which, the strand piece is to be conveyed, i.e., the interruption of operation is absolutely necessary until the strand piece to be diverted has moved totally out of one line and into that line into which it is to be brought, thus being conveyed further.

The invention aims at avoiding these drawbacks and difficulties and has as its object to provide a plant of the initially defined kind, which allows for the rolling of strand pieces from two or several casters by means of a single rolling mill, wherein, however, the casting and rolling operations may be organized in a largely flexible manner and, in particular, decoupling from a time-dependent diversion of a strand piece is to be ensured to the effect that not all of the lines involved in the diversion of a strand piece will be out of operation simultaneously for conveying further strand pieces; it rather is to be feasible, even after having started or terminated the diversion of a strand piece from one line into another line to keep the other line still going, nevertheless.

SUMMARY OF THE INVENTION

In accordance with the invention, this object is achieved in that at least one pivotable and/or laterally displaceable guide section is provided with two or several guide parts each serving to receive strand pieces and capable of being alternately aligned to register with the line of the rolling mill, wherein, in one position of this guide section, a pivotable and/or laterally displaceable guide section of an adjacently arranged line of a continuous caster is capable of being aligned to register with one of the guide parts of the guide section including two or several guide parts and, in this position, a second guide part of this guide section is aligned to register with the line of the rolling mill.

A preferred embodiment is characterized in that the guide parts of the guide section equipped with two or several guide parts are mutually arranged in a V-shaped manner and pivotable about an axis located in one of the lines of the continuous casters and rolling mill, respectively, and in the point of intersection of the longitudinal axes of the guide parts arranged in a V-shaped manner.

Another suitable embodiment is characterized in that the guide parts of the guide section equipped with two or several guide parts are arranged approximately parallel.

A plant enabling an even further decoupling of continuous casting from subsequent hot-rolling is characterized in that a furnace is provided between neighboring lines of a continuous caster and the rolling mill, wherein a guide part of a pivotable or laterally displaceable guide section is capable of being aligned to register with the furnace in one position and with the line of the rolling mill in a further position.

By arranging a furnace between the lines, an additional storage means is provided, into which a strand piece may be introduced while the line into which the strand piece is to be transferred afterwards is still continuously operating. With the operation of all lines being maintained, heat treatment of the strand piece may then be carried out in that furnace. This strand piece is transferred to the other line only after a free capacity has been logistically provided in this line. Thereby, the timing of the transfer is independent of a simultaneous interruption of the two lines involved.

Preferably, the furnace provided between the lines is stationarily arranged and designed as a storage furnace.

In a preferred manner, the guide sections and the guide parts are designed as furnaces.

A space-saving embodiment is characterized in that the rolling mill with its line is arranged to register with the line of one of the continuous casters, wherein it is, however, also feasible to arrange the rolling mill with its line between two neighboring lines of two continuous casters.

BRIEF DESCRIPTION OF THE DRAWINGS

In the following, the invention will be explained in more detail by way of four exemplary embodiments illustrated in the accompanying schematic drawing, wherein.

DETAILED DESCRIPTION OF PREFERRED EMBODIMENTS OF THE INVENTION

Figure 1:
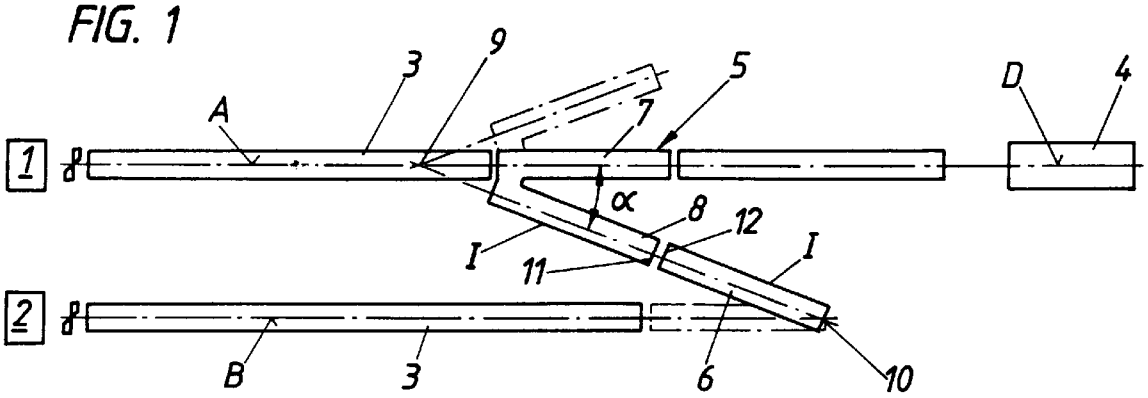
FIGS. 1 to 3 are top views on a first embodiment in different operating states.

Two continuous casters—for instance, for casting thin slabs, billets or blooms, etc.—are denoted by 1 and 2, respectively; the approximately parallelly oriented lines of these two continuous casters 1 and 2 bear the reference numerals A and B. A line is meant to denote the longitudinal central axis of the strand guide along which the strand is conveyed out of the continuous caster. The strands cast in these continuous casters 1 and 2, thus, are each moved along the two lines A and B, respectively, associated with the same. In the strand guide of each of the continuous casters 1 and 2, a separating means is each provided for cutting the strand into lengths, i.e., forming individual strand pieces. The strand pieces are moved on along lines A and B, wherein heat retention furnaces 3 and/or heating furnaces are provided in these lines such that the sensible heat still present in the strand pieces will be available as completely as possible to a subsequent rolling procedure following as immediately as possible at a very short time interval.

Aligned with line A of the continuous caster 1 is a rolling mill 4 whose line D coincides with line A. This rolling mill 4 serves to roll out the strand pieces obtained from the two continuous casters 1 and 2.

In order to be able to get a strand piece from the continuous caster 2 and its line B into line D of the rolling mill 4, pivotable guide sections 5 and 6 are provided in each of lines B and D of the continuous caster 2 and the rolling mill 4, respectively, which guide sections advantageously likewise are designed as heat retention furnaces or as heating furnaces. The guide section 5 provided in line D of the rolling mill 4 is comprised of two guide parts 7 and 8, each of which serves to receive strand pieces. There could also be provided more than two guide parts. These guide parts 7 and 8 enclose an angle a with. each other, the extent of this angle $\alpha$ being chosen such that, according to the position I illustrated in full lines in FIG. 1, one guide part 7 gets into alignment with line A and line D and the other guide part 8 gets into alignment with the guide section 6 arranged in line B, when the latter is in the position I illustrated by full lines in FIG. 1. In that case, the guide part 8 of the guide section 5 and the guide section 6 are each in a position oriented at an acute angle relative to lines D and B. The guide sections 5 and 6 may each be pivoted into positions II, which are illustrated in full lines in FIG. 2 and in which the guide part 8 of the guide section 5 and the guide section 6 register with lines D and B by their longitudinal axes. Actuating means of any kind not illustrated in detail serve to pivot the guide sections 5 and 6.

According to this embodiment, the transfer from line B into line D may be effected within a very short time, since the introduction of strand pieces from the guide section 6 of line B into the guide section 5 of line A, i.e., into the guide part 8 aligned to register with the guide section 6 in position I according to FIG. 1, is feasible while conveying strand pieces from line A to the rolling mill 4. After having pivoted the guide section 5 into the position II illustrated in FIG. 2, strand pieces from the guide part 8 can be supplied to the rolling mill 4.

Pivoting of the guide sections 5 and 6 is effected about pivot axes 9 and 10 located in lines D and B, respectively, wherein the pivot axis 9 associated with the guide section 5 is located in the point of intersection of the longitudinal axes of the guide parts 7 and 8.

Figure 2:
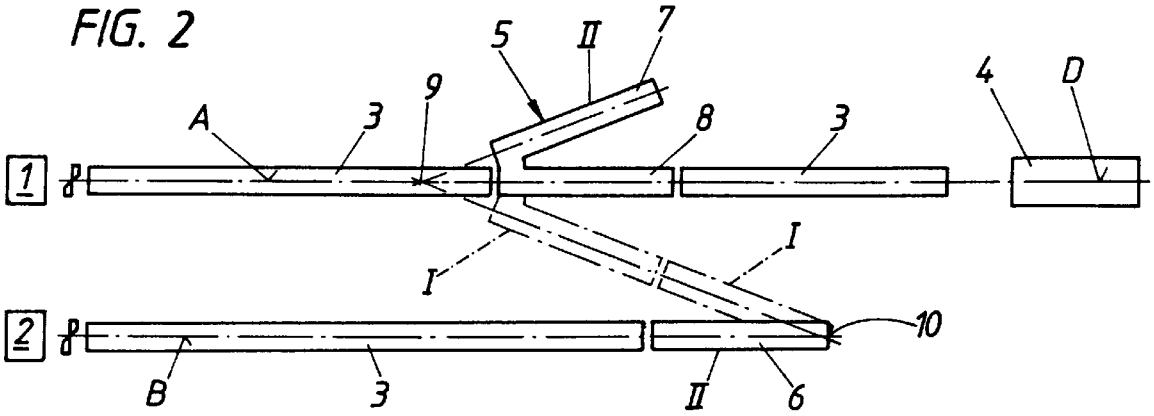

The overall plant depicted in FIGS. 1 to 3 functions in the following manner:

If a strand piece such as, for instance, a thin slab is to be transferred from line B into line D of the rolling mill 4, the strand piece at first is introduced into the guide section 6 associated with line B, said guide section 6 being in the position II registering with line B (FIG. 2). After this, the guide section 6 is pivoted into position I (FIG. 1); it is then aligned to register with the guide part 8 of the guide section 5 in position I, and the strand piece can be introduced into the guide part 8.

Subsequently, the guide section 6 associated with line B may be pivoted back again so as to be in alignment with line B. In that position, the guide section 6 can take up a new strand piece. As soon as line D has been cleared, the guide section 5 is pivoted into position II, which position is illustrated in FIG. 2. Now the strand piece from guide part 8 can be introduced into line D and supplied to the rolling mill 4. After this, the guide section 5 may be pivoted back into position I as illustrated in FIG. 3.

The lengths of the guide parts 7, 8 of the guide section 5 and the length of the guide section 6 are dimensioned such that their free ends 11, 12 join each other in the aligned position of the guide section 6 with the guide part 8.

Figure 3:
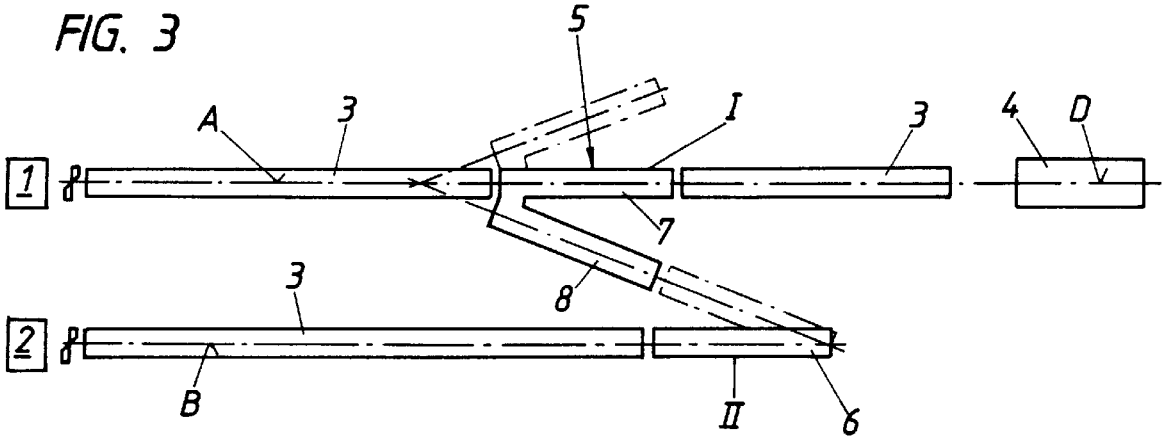

According to FIGS. 1 to 3, the transfer of a strand piece from line B into line D is effected by a two-time inversion of the direction to a major extent. This need, however, not be the case; the arrangement also could be devised such that no inversion of the direction is necessary for diverting the strand piece, but the strand piece during its diversion always merely moves by an acute angle relative to the direction in which it emerges from the casting machine.

Rollers and, preferably driven rollers, are provided in lines A and B for conveying the strand pieces along these lines. The guide sections 5 and 6 also comprise driven rollers, the actuating means having to be reversible in case of an inversion of the direction at a transfer from line B into line D.

Both the guide section 5 including two V-shaped guide parts 7 and 8 and the guide section 6 may be replaced with a guide section capable of being laterally transferred, e.g., moved parallel or displaced parallel, wherein the guide section 5 is equipped with two or several guide parts arranged approximately parallel. The arrangement would have to be such that in one position of the guide section 5 one of its guide parts registered with line D of the rolling mill 4 and another one of its guide parts registered with the guide section 6 associated with line B and moved into a position between lines B and D. It would also be conceivable to equip a guide section 5 with more than two guide parts, which are displaceable in aligned positions with a line of a continuous caster and with the line D of the rolling mill one after the other.

Figure 4:
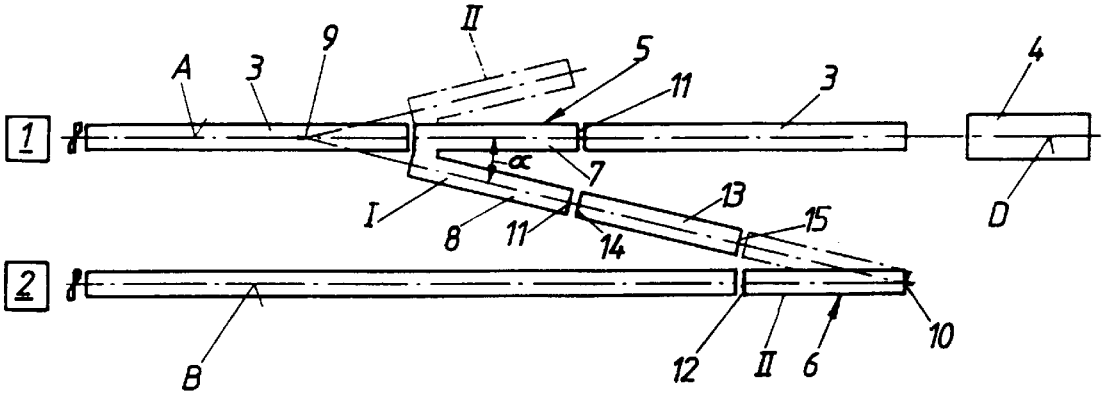
FIGS. 4 to 6 depict another embodiment in illustrations analogous to FIGS. 1 to 3.
Figure 5:
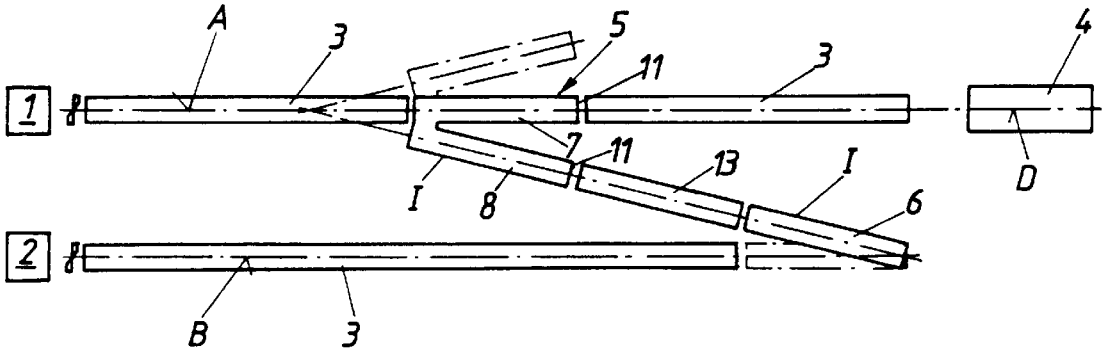
Figure 6:
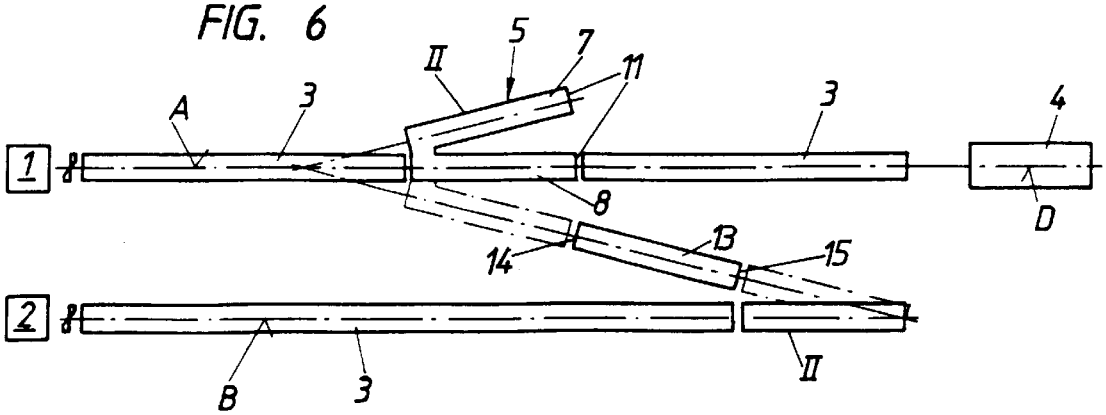

According to the embodiment depicted in FIGS. 4 to 6, a furnace 13 is provided between the two lines A and D, which furnace is designed as a temperature equalizing furnace, a heat retention furnace or a heating furnace and preferably is stationarily arranged. This furnace 13, which advantageously functions as a storage furnace, in its longitudinal direction is oriented to register with the guide sections 5 and 6 in the positions I of these guide sections 5 and 6, in which the guide sections 5 and 6 associated with lines D and B are in alignment. One guide section 5 and 6 each, i.e., the guide part 8 of the guide section 5, with one free end 11 and 12, respectively, joins an end 14 or 15, respectively, of the furnace 13 in the pivoted position in which the two guide section 5 and 6 are in alignment. The lengths of the guide parts 7, 8 of the guide section 6 and of the furnace 13 arranged between lines D and B is determined as a function of the required specific weights of the strand pieces and the thicknesses of the strand pieces.

The overall plant depicted in FIGS. 4 to 6 functions in the following manner:

If a strand piece such as, for instance, a thin slag, is to be transferred from line B into line D of the rolling mill 4, the strand piece at first is introduced into the guide section 6 associated with line B, said guide section 6 being in the position II in alignment with line B (FIG. 4). After this, the guide section 6 is aligned to register with the furnace 13 arranged between lines A and D, i.e., pivoted into position I, the strand piece, thus, being introducible into the furnace 13. Position I is illustrated in FIG. 5.

Subsequently, the guide section 6 associated with line B may be pivoted back again so as to be in alignment with line B anew (FIG. 6). As soon as line D has been cleared, i.e., the guide part 8 of the guide section 5 associated with lines D and A is not occupied, the guide section 5 is pivoted into a position I in alignment with the furnace 13, which position is illustrated in FIG. 4. Now the strand piece can be introduced into guide section 5 associated with lines D and A, i.e., its guide part 8, whereupon the guide section 5 with its guide part 8 may be pivoted back into a position II in alignment with line D and the strand piece can be suppplied to the rolling mill 4.

In the overall plant position depicted in FIG. 4, a strand piece from line A can be transferred to the guide section 5 associated therewith and further conveyed to rolling. At the same time, a strand piece in line B can be introduced into the guide section 6 associated with that line and also into guide section 5. According to FIG. 5, a strand piece from line B can be introduced into the furnace 13 arranged between line D and B and, at the same time, a strand piece in line A can be introduced into the guide section 5 associated with that line, and further conveyed to rolling. According to FIG. 6, the strand piece previously introduced into the guide part 8 can be supplied to the rolling mill 4.

The pivotable guide sections 5, 6 may be replaced with laterally transferable guide sections also in this case, the lateral transfer being feasible, for instance, by parallelly moving or parallelly displacing the guide sections. In this case, the furnace 13 arranged between lines B and D would be oriented approximately parallel with lines A, B and D.

Figure 7:
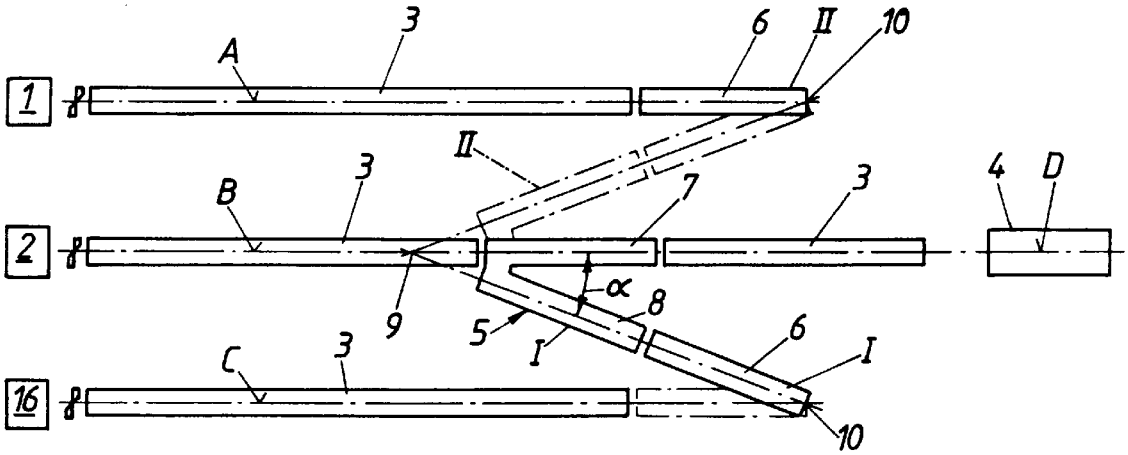
FIGS. 7 and 8 depict a third embodiment in illustrations analogous to FIGS. 1 and 2.
Figure 8:
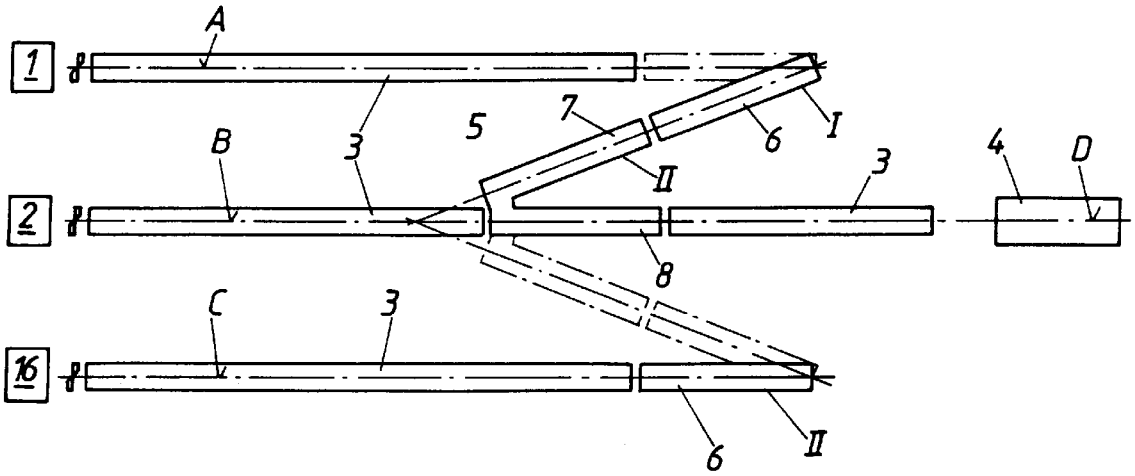

According to the embodiment illustrated in FIGS. 7 and 8, three continuous casters 1, 2 and 16 are adjacently arranged with parallel lines of these continuous casters 1, 2 and 16, namely A, B and C resulting. The rolling mill 4 with its line D is arranged to register with line B. In this case, the guide section 5 with two guide parts 7 and 8, which likewise enclose an angle $\alpha$, is arranged in the centrally arranged lines B and D and, by pivoting this guide section 5, it is feasible to align its guide parts 7 and 8 so as to register with the pivotable guide sections 6 of the neighboring lines A and C. In both of the pivoted positions I and II represented in FIGS. 7 and 8, one of the guide parts 7 and 8 of the pivotable guide section 5 is each aligned to register with line B and line D, respectively.

Figure 9:
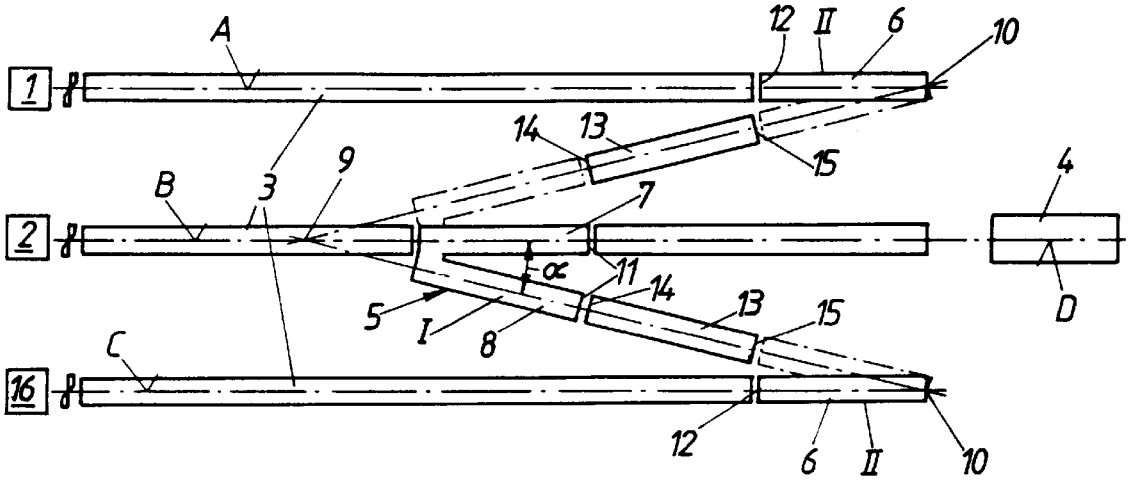
FIGS. 9 and 10 show a fourth variant in illustrations analogous to FIGS. 7 and 8.
Figure 10:
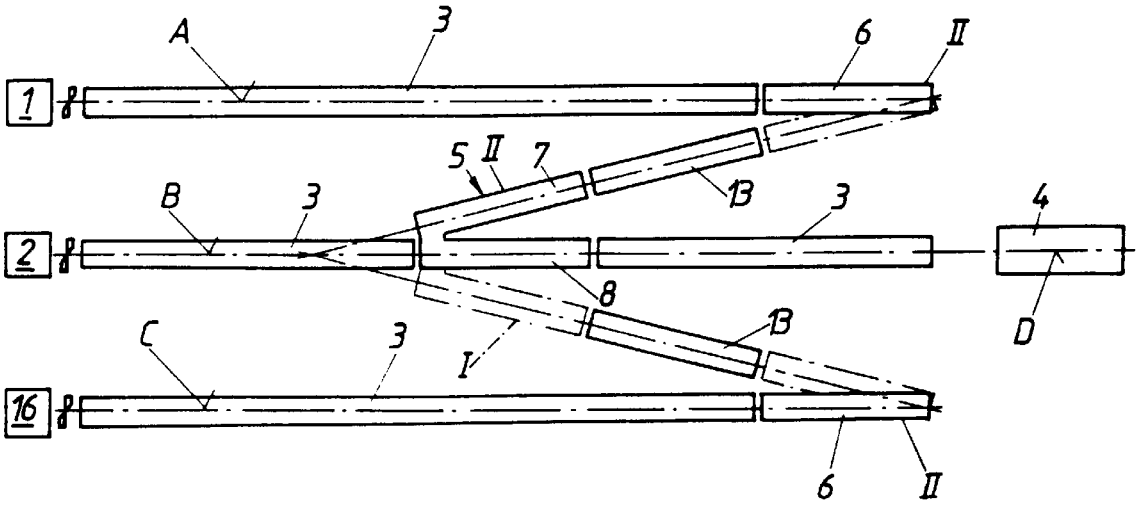

According to the embodiment illustrated in FIGS. 9 and 10, three continuous casters 1, 2 and 16 are again adjacently arranged with parallel lines of these continuous casters 1, 2 and 16, namely A, B and C resulting. The rolling mill 4 with its line D is arranged to register with line B. Also in this case, a guide section 5 with two guide parts 7 and 8, which likewise enclose an angle $\alpha$, is arranged in the centrally arranged lines B and D and, by pivoting this guide section 5, it is feasible to align its guide parts 7 and 8 so as to register once with the furnace 13 arranged between lines A and D and once, by the other guide part 8, with the furnace 13 arranged between lines C and D. In both of the pivoted positions represented in FIGS. 9 and 10, one of the guide parts 7 and 8 of the pivotable guide section 5 is each aligned to register with line B and line D.

The guide section 5 including two V-shaped guide parts 7 and 8 also according to this variant may be replaced with a guide section that is laterally transferable, e.g., parallelly movable or parallelly displaceable and equipped with two or several guide parts arranged approximately parallel, wherein the arrangement likewise would have to be such that in one position of the guide section one of the guide parts is in alignment with line D of the rolling mill 4 and the other one of the guide parts is in alignment with the furnace 13 provided between line D of the rolling mill 4 and line C of a continuous caster 1 or 16, respectively, which does not register with the rolling mill 4. That other guide part would have to be placeable in alignment with line D of the rolling mill 4 by parallel displacement or movement.

If the guide sections 5 and 6 are designed as furnaces, the furnaces for economic reasons are configured to each accommodate but a single strand piece, this applying to the guide section 5 to the effect that each of its guide parts 7 and 8 will receive but a single strand piece. The guide sections 5 and 6 do not have storage function but only transporting as well as heat retaining and temperature equalizing functions.

It goes without saying that the number of continuous casters may vary, as may the number of rolling mills associated therewith. Thus, it is, for instance, conceivable to associate two rolling mills with three, four or five continuous casters with the inventive idea being realizable as well.

What we claim is:

1. In a plant for producing a hot-rolled product from a cast strand, of the type including at least two continuous casters, a rolling mill associated with said at least two continuous casters and guide section means adapted to transport a strand piece separated from said cast strand, each of said continuous casters having a longitudinal central axis constituting a caster line and said rolling mill having a longitudinal central axis constituting a rolling mill line and said guide section means including pivotable or laterally displaceable guide section means respectively provided in at least one rolling mill line and in a caster line not registering with said rolling mill line, said pivotable or laterally displaceable guide section means being adapted to transport a strand piece out of said caster line not registering with said rolling mill line into said rolling mill and capable of being aligned in a mutually registering position, the improvement wherein at least one of said pivotable or laterally displaceable guide section means comprises at least two guide parts each adapted to receive a strand piece and capable of being alternately aligned to register with said rolling mill line, and wherein, in a defined position of said at least one of said pivotable or laterally displaceable guide section means, a pivotable or laterally displaceable guide section means of an adjacently arranged continuous caster line is capable of being aligned to register with one of said at least two guide parts of said guide section means comprising at least two guide parts and, in said defined position, another one of said at least two guide parts of said guide section means comprising at least two guide parts is aligned so as to register with said rolling mill line.

2. A plant as set forth in claim 1, wherein said at least two guide parts of said guide section means comprising at least two guide parts are mutually arranged in a V-shaped manner and pivotable about an axis located in one of said continuous caster lines and said rolling mill line and in the point of intersection of the longitudinal axes of said guide parts mutually arranged in V-shaped manner.

3. A plant as set forth in claim 1, wherein said at least two guide parts of said guide section means comprising at least two guide parts are arranged approximately parallel.

4. A plant as set forth in claim 1, further comprising a furnace provided between neighboring continuous caster lines and said rolling mill line, and wherein a guide part of one of said pivotable or laterally displaceable guide section means is alignable so as to register with said furnace in a first position and with said rolling mill line in a further position.

5. A plant as set forth in claim 4, wherein said furnace is stationarily arranged.

6. A plant as set forth in claim 4, wherein said furnace is designed as a storage furnace.

7. A plant as set forth in claim 1, wherein said guide section means and said guide parts are designed as furnace means.

8. A plant as set forth in claim 1, wherein said rolling mill line is arranged in alignment with one of said continuous caster lines.

* * * * *